United States Patent [19]

Fujita

[11] Patent Number: 4,725,077

[45] Date of Patent: Feb. 16, 1988

[54] STICKER TO BE ADHERED ON ENVELOPES OR POSTCARDS

[76] Inventor: Kazuaki Fujita, 2-37, Takamatsu, Toshima-ku, Tokyo, Japan

[21] Appl. No.: 935,628

[22] Filed: Nov. 25, 1986

Related U.S. Application Data

[63] Continuation of Ser. No. 679,957, Dec. 10, 1984, abandoned.

[51] Int. Cl.[4] ..... B42D 15/00

[52] U.S. Cl. ..... 283/67; 283/81; 283/903

[58] Field of Search ..... 283/81, 903, 1 R, 67

[56] References Cited

U.S. PATENT DOCUMENTS 3,940,124 2/1976 Johnsen ..... 283/903 X

FOREIGN PATENT DOCUMENTS 1188160 9/1959 France ..... 283/903
3272 of 1861 United Kingdom ..... 283/56
139092 2/1920 United Kingdom ..... 283/56

OTHER PUBLICATIONS

Research Disclosure *Package Labels*, #19161, Mar. 1980, Crowforth, D. L.

*Primary Examiner*—Paul A. Bell
*Attorney, Agent, or Firm*—Jordan and Hamburg

[57] ABSTRACT

Disclosed is a sticker which is adapted to be adhered on mail such as a postcard, an envelope, or a direct-mail advertising, etc. The sticker has columns in which a lottery number with a time limit and an advertisement are printed, so that a person who receives the mail with the sticker is given chance to win a premium by lottery.

14 Claims, 2 Drawing Figures

STICKER TO BE ADHERED ON ENVELOPES OR POSTCARDS

This is a continuation of application Ser. No. 679,957, filed on Dec. 10, 1984, now abandoned.

BACKGROUND OF THE INVENTION

1. Field of the Invention

The present invention is broadly concerned with a sticker to be adhered on an envelope or a postcard and is particularly intended to provide a sticker of the type described above on which an advertisement and a lottery number offering premiums or a prize, etc., are printed.

2. Description of Prior Art

When direct mail is sent from a sponsor to each customer in an attempt to inform him of an event, a bargain sale, or the like, or to introduce new goods, a lottery number may be printed on the mail with the expectation that the information or the introduction will effectively impress the customer. The direct mail having a lottery number is kept till the winning numbers are announced, so that a high advertisement effect can be expected. In the case where the lottery numbers are announced at a hall, it can be expected to have a lot of people come to see the winning numbers. Since the lottery number is direectly printed on a postcard or an envelope by a sponsor, the number is used only for direct mail.

It is a Japanese custom to send new year greeting cards to their relatives or friends. Greeting cards with lottery numbers which are issued by the Postal Administration Ministry are sold. The kind of greeting cards are brought by people who want to send them to their relatives or friends. Those who received the cards will be able to expect to win the premiums by lot. The advertisement can be effective when it is printed on these greeting cards, since they can be looked at at least four times, that is, at the time of buying them, writing on them, receiving them, and comparing their numbers with the winning numbers. However, people must buy the greeting cards at their expense and the utilization is limited to new year greeting cards only.

SUMMARY OF THE INVENTION

An object of the present invention is to offer stickers to be adhered on envelopes, postcards, direct mail, or the like to exhibit effective advertising.

Another object of this invention is to offer stickers which are aimed such that the producing costs thereof and premiums are charged by a sponsor who desires to distribute the stickers without cost, so that people to whom the stickers are distributed can desirably stick them on any mail and send them to other people.

The sticker according to this present invention is featured in that it is able to be adhered on a part of an envelope or a postcard and it has a column in which a lottery number with time limit and an advertisement message are printed.

In a preferred embodiment according to this invention, in addition to the above-mentioned column, the sticker has another column in which the term of validity, the name of the issuer, etc. are printed. A patron or a sponsor owes the cost for premiums and the cost required for issuing stickers, so that the sponsor distributes the stickers to their desired destinations without fee. The term of validity is determined to be long, for example, for one year or three years, etc., and the lottery is performed every month or every three months. In this way, a person who receives mail with such a sticker looks at it when he receives and every time when the winning numbers are announced, so that the advertisement effect can be increased.

DETAILED DESCRIPTION OF PREFERRED EMBODIMENT

Figure 1:
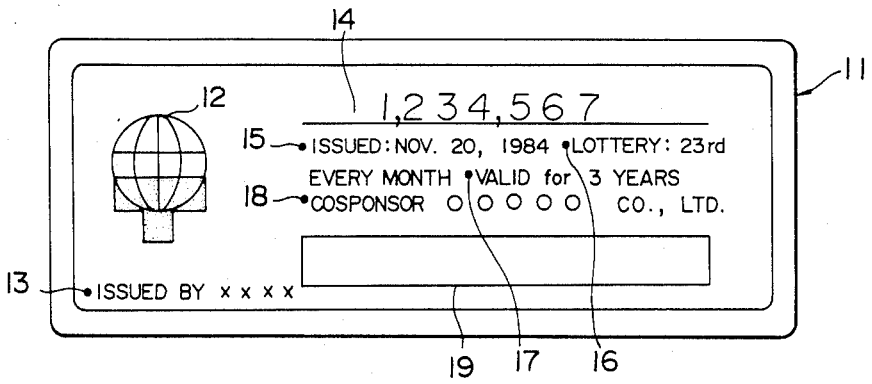
FIG. 1 is a plan view of a preferred embodiment of a sticker according to the present invention.

Referring to the drawings, a preferred embodiment of the present invention will be described hereunder.

The sticker has such a size that it is allowed to be adhered on a part of a postcard or an envelope, and a pressure-sensitive adhesive agent (not shown) is applied on the back of the sticker. On the upper surface of the sticker, in addition to a symbol mark 12 and a column 13 in which the name of issuer is printed, there are provided six columns 14 to 19, that is, a column for printing a lottery number 14, a column 15 for printing the date of issuance, a column 16 for printing the date of lottery, a column 17 for printing the term of validity, a column 18 for printing the name of the cooperating sponsor offering premiums or prizes, and a column 19 for printing an advertisement.

Figure 2:
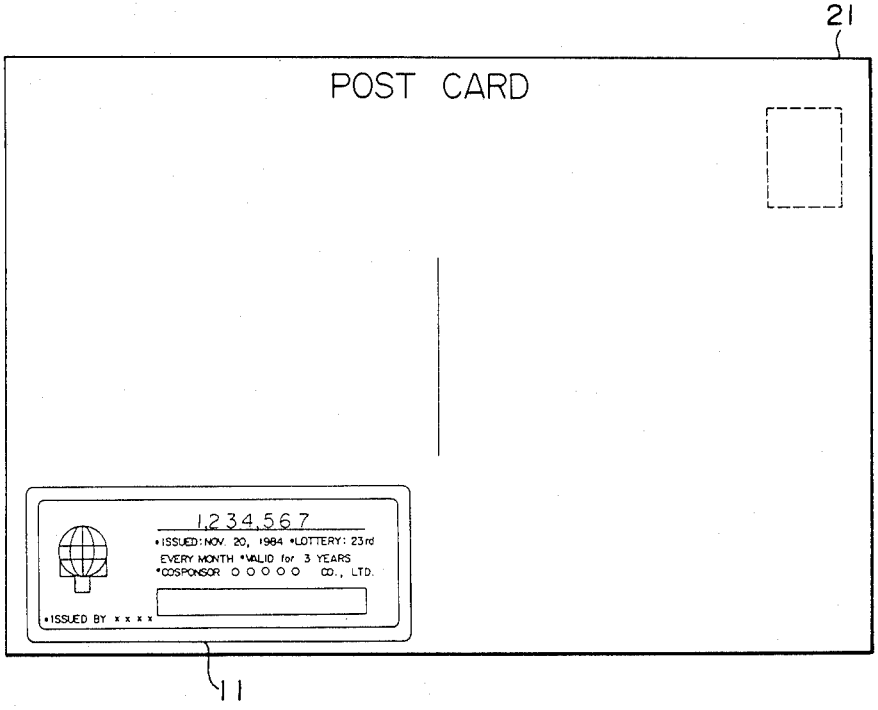
FIG. 2 is a plan view showing the state where the sticker is adhered on a postcard.

As shown in FIG. 2, the sticker 11 has such a size that it is allowed to be adhered, for example, onto a right-hand lower part of a postcard, so that the sticker can be used for a picture postcard or a printed postcard which informs persons of new goods or entertainments printed on the back of the postcard. The space at the upper portion of the sticker 11 may be be used for writing comments, etc.

The stickers 11 are prepared in such a manner that the issuer whose name is printed in the column 13 collects a patron and/or a sponsor, prizes or premiums used for the lottery are prepared, and the name, address, telephone number of the sponsor and an advertisement are printed on the stickers 11. The stickers 11 are distributed without fee to customers, schools, welfare facilities, etc., in the location designated by the sponsor. Those who have received sticker 11 adhered the stickers on envelopes and/or postcards and mail the envelopes and/or postcards to their friends, relatives, or the like. In the case the sponsor is a maker or manufacturer, he may distribute a large numbers of these stickers to his agents so that the agents may adhere the stickers on direct mail advertisings to be sent by the agents to their clients.

In the embodiment described above, the lottery is performed on the twentieth of every month and the term of validity is set for three years from the date of issuance, the receiver of the mail with the sticker has thirty-six chances of winning and looks at the advertisement every time, so that a remarkable advertisement effect can be expected.

As described above, the sticker according to this invention has a remarkable advertisement effect and can increase the utility value of the mailing.

What is claimed is:

1. A method of advertising utilizing a mail item such as a postcard or mailing envelope comprising the steps of printing a sticker with a first item representing a lottery number, printing said sticker with a second item representing the date of issuance of the sticker, printing the said sticker with a third item representing the date of expiration of the lottery, determining said date of expiration to be a plurality of months after said date of issuance, printing said sticker with a fourth item representing the day of the month on which the lottery is performed such that a plurality of said days of the month on which the lottery is performed occurs between said date of issuance and said date of expiration, printing said sticker with a fifth item representing the name of a sponsor offering premiums or prizes for the lottery, printing said sticker with a sixth item separate and distinct from said fifth item representing an advertisement, distributing said printed sticker free of charge to a sticker user, affixing said sticker with a pressure-sensitive adhesive onto said mail item, depositing said mail item into the postal system for delivery to an addressee, performing a plurality of lottery offerings for said sticker on the day of the month represented by said fourth item and which occurs between said date of issuance and said date of expiration, whereby the printed lottery information on the first to fourth items enhances and prolongs the advertising effect of said advertisement on said sticker in that a plurality of monthly lotteries are performed with said sticker on the same day of the month printed on said fourth item over a plurality of months between said date of issuance and said date of expiration.

2. A method according to claim 1, wherein the time between said date of issuance and said date of expiration is at least twelve months.

3. A method according to claim 1, wherein the time between said date of issuance and said date of expiration is at least twenty-four months.

4. A method according to claim 1, wherein the time between said date of issuance and said date of expiration is at least thirty-six months.

5. A method according to claim 2, wherein said step of performing a plurality of lottery offerings comprises performing at least twelve of said lottery offerings.

6. A method according to claim 2, wherein said step of performing a plurality of lottery offerings comprises performing at least four of said lottery offerings.

7. A mail advertising device comprising a mail item such as a postcard or mailing envelope which is adapted to be posted through the mail, a sticker body having a front and a back, pressure-sensitive adhesive on said back of said sticker body such that said sticker body is adhered onto said mail item by said pressure-sensitive adhesive, said front of said sticker having a first item printed with a lottery number, a second item printed with the date of issuance of the sticker, a third item printed with the date of expiration of the lottery, said date of expiration being at least twelve months after said date of issuance, a fourth item printed with the day of the month on which the lottery is performed, a fifth item printed with the name of sponsor offering a premium or prizes for the lottery, and a sixth item separate and distinct from said fifth item printed with an advertisement, whereby the lottery information on the first to fourth items enhances and prolongs the advertising effect of said advertisement on said sticker in that at least four monthly lotteries are performed with said sticker on the same date of the month provided in the fourth item over the at least twelve month period between said date of issuance and said date of expiration.

8. A method of advertising utilizing a mail item such as a postcard or mailing envelope comprising the steps of printing a sticker with a first item representing a lottery number, printing said sticker with a second item representing the date of issuance of the sticker, printing said sticker with a third item representing the date of expiration of the lottery, said date of expiration being at least twelve months after said date of issuance, printing said sticker with a fourth item representing the day of the month on which the lottery is performed, printing said sticker with a fifth item representing the name of a sponsor offering premiums or prizes for the lottery, printing said sticker with a sixth item separate and distinct from said fifth item representing an advertisement, distributing said printed sticker free of charge to a sticker user, affixing said sticker with a pressure-sensitive adhesive onto said mail item, depositing said mail item into the postal system for delivery to an addressee, performing at least four lottery offerings for said sticker on the day of the month represented by said fourth item and which occurs between said date of issuance and said date of expiration, whereby the printed lottery information on the first to fourth items enhances and prolongs the advertising effect of said advertisement on said sticker in that said at least four monthly lotteries are performed with said sticker on the same day of the month printed on said fourth item over the at least twelve month period between said date of issuance and said date of expiration.

9. A mail advertising device comprising a mail item such as a postcard or mailing envelope which is adapted to be posted through the mail, a sticker body having a front and a back, pressure-sensitive adhesive on said back of said sticker body such that said sticker body is adhered onto said mail item by said pressure-sensitive adhesive, said front of said sticker having a first item printed with a lottery number, a second item printed with the date of issuance of the sticker, a third item printed with the date of expiration of the lottery, said date of expiration being a plurality of months after said date of issuance, a fourth item printed with the day of the month on which the lottery is performed such that a plurality of said days of the month on which the lottery is performed occurs between said date of issuance and said date of expiration, a fifth item printed with the name of sponsor offering a premium or prizes for the lottery, and a sixth item separate and distinct from said fifth item printed with an advertisement, whereby the lottery information on the first to fourth items enhances and prolongs the advertising effect of said advertisement on said sticker in that a plurality of monthly lotteries are performed with said sticker on the day of the month printed in the fourth item over a plurality of months between said date of issuance to said date of expiration.

10. A mail advertising device according to claim 9, wherein said plurality of months between said date of issuance and said date of expiration is at least twelve months.

11. A mail advertising device according to claim 9, wherein said plurality of months between said date of issuance and said date of expiration is at least twenty-four months.

12. A mail advertising device according to claim 9, wherein said plurality of months between said date of issuance and said date of expiration is at least thirty-six months.

13. A mail advertising device according to claim 10, wherein said plurality of days on which said lottery is performed comprises at least twelve days all on the same day of the month.

14. A mail advertising device according to claim 10, wherein said plurality of days on which said lottery is performed comprises at least four days all on the same day of the month.

* * * * *